United States Patent [19]

Kubik

[11] 4,043,127

[45] Aug. 23, 1977

[54] RESERVOIR HOUSING

[76] Inventor: Philip A. Kubik, 6809 Spruce Drive, Birmingham, Mich. 48010

[21] Appl. No.: 666,084

[22] Filed: Mar. 11, 1976

Related U.S. Application Data

[62] Division of Ser. No. 592,414, July 2, 1975, Pat. No. 3,973,189.

[51] Int. Cl.[2] ..... F15B 15/18; F15B 21/04

[52] U.S. Cl. ..... 60/453; 60/477; 60/DIG. 10; 60/454

[58] Field of Search ..... 60/453, 454, 456, 477, 60/DIG. 10

[56] References Cited

U.S. PATENT DOCUMENTS

| | | | |
|---|---|---|---|
| 2,460,058 | 1/1949 | Brodeur | 60/454 |
| 2,543,989 | 3/1951 | Rockwell | 60/453 X |
| 3,225,543 | 12/1965 | Vivier | 60/454 X |
| 3,791,148 | 2/1974 | Alcock et al. | 60/456 |
| 3,928,969 | 12/1975 | Picker | 60/DIG. 10 X |

*Primary Examiner*—Edgar W. Geoghegan

*Attorney, Agent, or Firm*—Andrew R. Basile

[57] ABSTRACT

A closed-loop hydrostatic drive unit having a variable displacement fluid pump driven by an electric motor for generating high-pressure fluid adapted to be communicated to a fluid motor and returned to the fluid pump via a high-pressure filter. The closed-loop hydrostatic drive unit is mounted to a rectangularly-shaped reservoir housing having upper and bottom surfaces connected by side walls and end walls to define therein a chamber for the storage of fluid at a low pressure which is communicated to the fluid pump via a charge pump and suitable conduits and check valves. In a first embodiment of the invention the interior of the reservoir housing is divided by means of a partition to define the fluid-holding chamber, while the remaining portion of the reservoir housing defines a separate chamber for the mounting and storage of the high-pressure filter and/or other selected fluid power components. In a second embodiment of the invention the housing walls define the fluid holding chamber while the high-pressure fluid filter housing extends into and is stored within the low-pressure fluid holding chamber.

1 Claim, 8 Drawing Figures

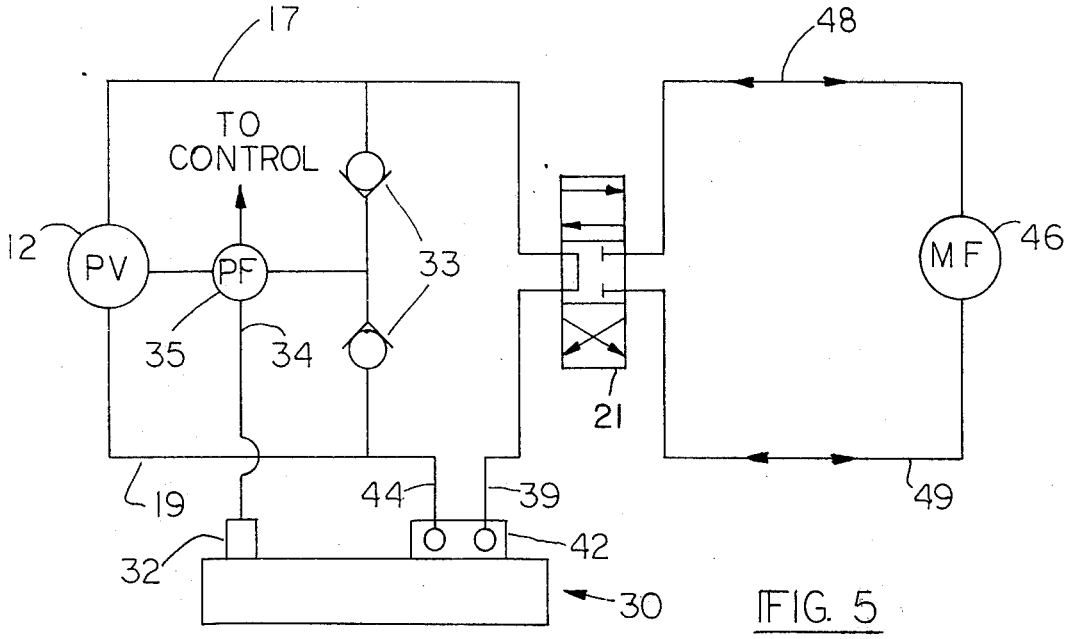
FIG. 5
FIG. 6
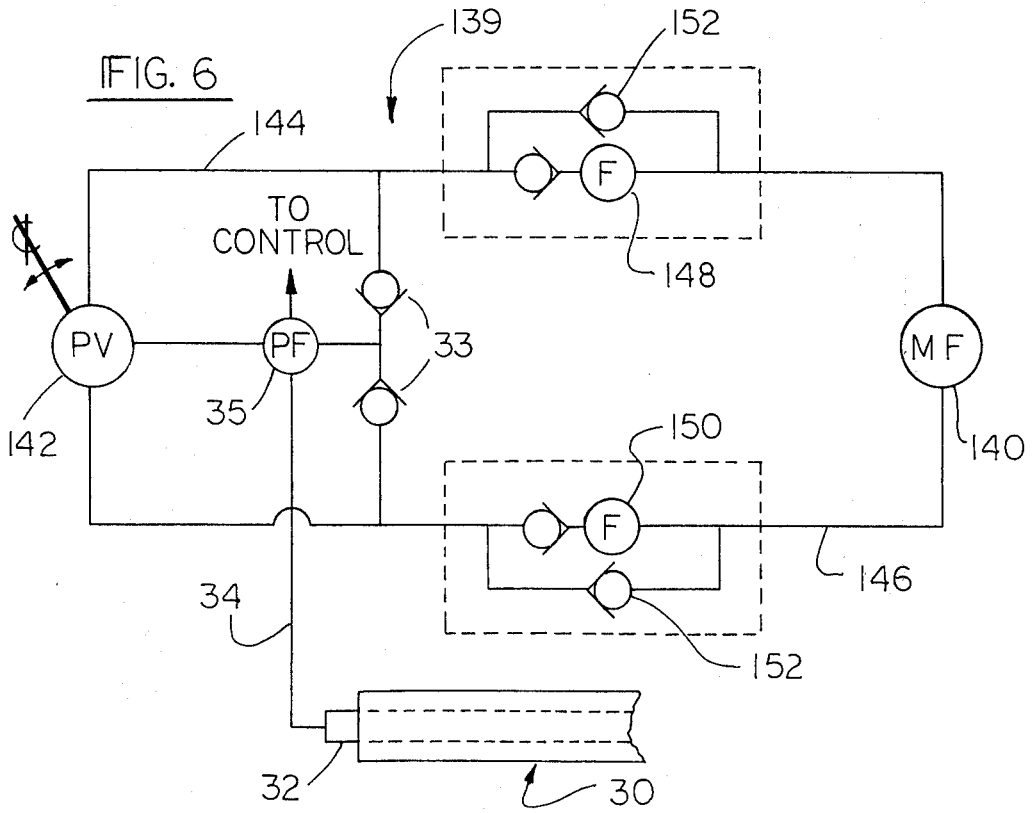

RESERVOIR HOUSING

This is a divisional of application Ser. No. 592,414 filed July 2, 1975 now U.S. Pat. No. 3,973,189 granted Aug. 31, 1976.

BACKGROUND OF THE INVENTION

I. Field of the Invention

The present invention relates to a closed-loop hydrostatic drive and, in particular, the present invention relates to a new and improved reservoir housing for supporting such units in a simple and compact fashion.

II. Description of the Prior Art

Heretofore numerous fluid systems have been employed wherein a fluid pump is driven by an electric motor, or other suitable prime mover, and wherein the fluid pump draws fluid from a fluid reservoir to communicate the same under pressure to a fluid motor to drive the same and wherein a high-pressure filter is disposed between the motor and the pump to insure that the fluid returned to the pump is free of impurities. While such systems have been assembled and constructed in such a manner that the reservoir may become an integral part of such systems, to the knowledge of the inventor there are no known reservoir housings for supporting units of the type disclosed herein.

SUMMARY OF THE INVENTION

The present invention which will be described hereinafter in greater detail comprises a reservoir housing having an enclosed fluid holding chamber for the storage of fluid at a low pressure and an upper support surface on which a closed-loop hydrostatic drive unit is supported. The reservoir housing is provided with means for the mounting and storage of a high-pressure fluid filter, either separately from and adjacent to the fluid holding chamber or directly within the fluid holding chamber.

It is therefore a primary object of the present invention to provide a new and improved reservoir housing which functions as a simple and compact means for supporting a closed-loop hydrostatic drive unit.

It is a further object of the present invention to provide a new and improved reservoir housing for such closed-loop hydrostatic drive units wherein the housing has means for supporting hydraulic components within the housing adjacent to the fluid holding chamber or directly within the fluid holding chamber.

Other objects, advantages and applications of the present invention will become apparent to those skilled in the art of closed-loop hydrostatic drive units and, in particular, in the art of fluid reservoirs associated with such units when the accompanying description of several examples of the best modes contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and in which:

FIG. 5 is a schematic circuit diagram of one example of a closed-loop hydrostatic drive unit;

FIG. 6 is a schematic circuit diagram of a second example of a closed-loop hydrostatic drive unit;

DESCRIPTION OF THE PREFERRED EMBODIMENTS

Figure 1:
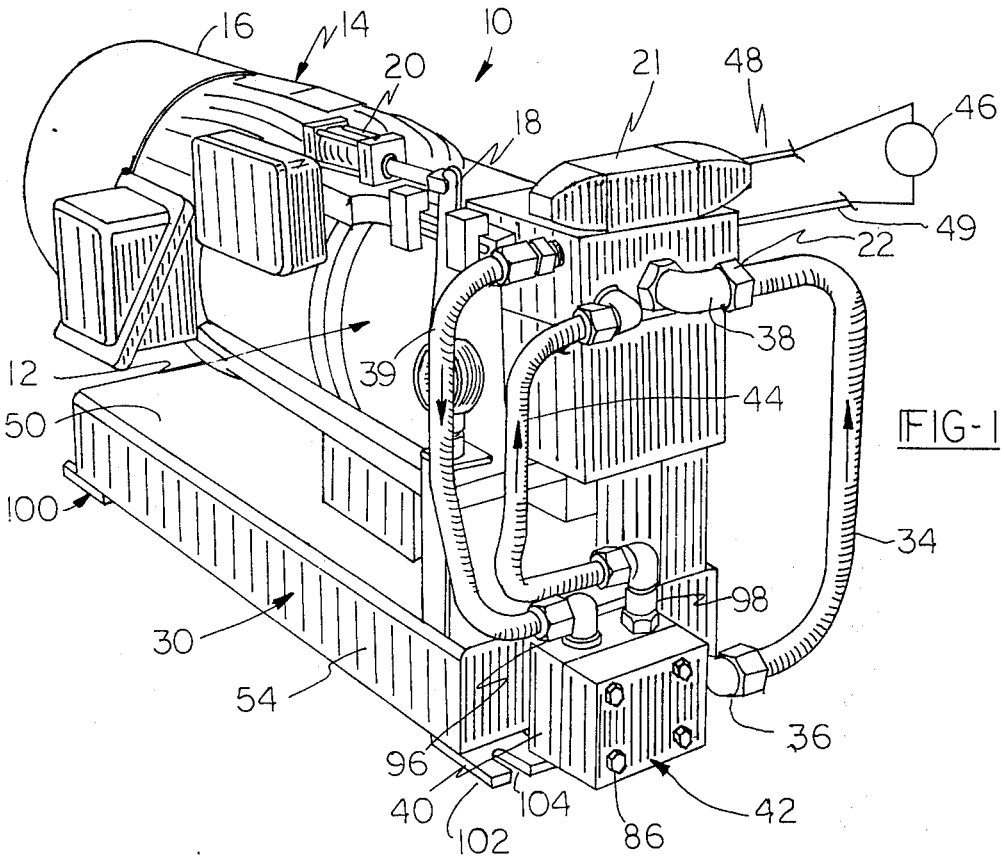
FIG. 1 is a perspective view of a hydrostatic drive unit mounted to the upper support surface of a reservoir housing constructed in accordance with the principles of the present invention.

Referring now to the drawings and, in particular, to FIG. 1 wherein there is illustrated one example of the present invention in the form of a hydrostatic drive unit 10 which comprises a fluid pump 12 driven by an electric motor 14 having an air cooling radiator and fan 16 mounted at the rear end thereof. The fluid pump 12 is provided with a stroke-control rod 18 which is selectively positioned by means of a fluid cylinder 20 so as to control the rate at which fluid is discharged from the pump 12 to a directional control valve 21 by means of a passageway 17 (FIG. 5) in a manifold 22 carried at the forward end of the fluid pump 12. Fluid is returned from the valve 21 to the pump 12 via a passageway 19 in the manifold 22 and a filter 42 as will be described in greater detail hereinafter. The electric motor 14, the fluid pump 12, and the other equipment which forms a part of the hydrostatic drive unit 10 are mounted on and fully supported by the inventive reservoir housing 30, the construction of which provides for compactness in size and ease in handling and will be described in greater detail hereinafter. The reservoir housing 30 has a fluid chamber 31 (FIG. 3) with an outlet 32 that is communicated to the inlet side of an integral charge pump 35 by means of a conduit 34 having a coupling 36 attached to the reservoir housing outlet 32 and a coupling 38 attached to the manifold 22. A conventional check valve arrangement 33 communicates fluid discharged from the charge pump 35 to the passageways 17 and 19 to replenish the system.

The manifold 22 also functions to communicate the fluid returned from the motor 46 to the high-pressure filter 42. This is accomplished by a conduit 39 connected to a filter manifold 40 of the high-pressure filter 42 which, in turn, is stored within the interior of the reservoir housing 30. The fluid filtered through the filter 42 is returned by means of a conduit 44 to the manifold 22 and communicated to the pump 12 via passageway 19.

The directional control valve 21 in the present example is adapted to selectively communicate fluid under pressure from pump 12 to a suitable fluid motor, such as a rotary motor or an equal displacement fluid cylinder schematically illustrated at motor 46 by means of conduits 48 and 49. Conduits 48 and 49 are connected to the valve 21 by means of the manifold 22. A more detailed description of several examples of circuits of the type described herein may be found by reference to U.S. Pat. Nos. 3,653,208 and 3,700,356. Fluid from the charge pump 35 is used to actuate the cylinder 20, all in a manner described in the aforementioned patents.

Figure 2:
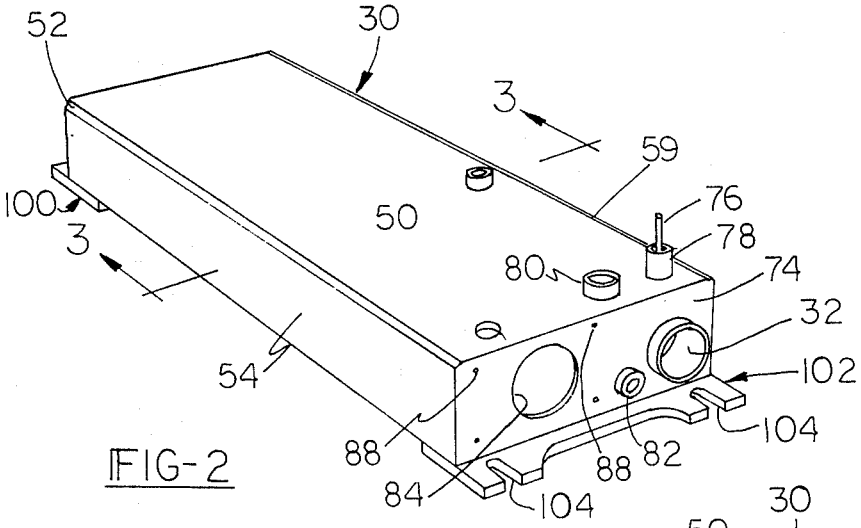
FIG. 2 is a perspective view of the reservoir housing illustrated in FIG. 1 with the hydrostatic drive unit removed.
Figure 3:
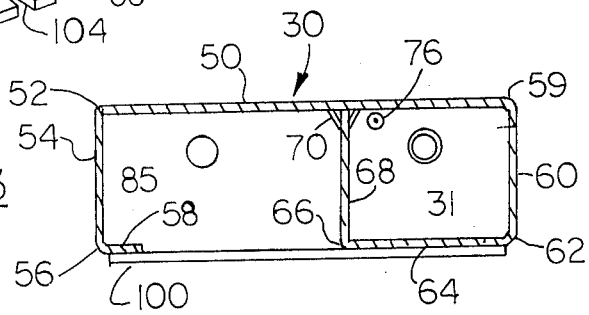
FIG. 3 is a cross-sectional view of the reservoir housing taken along Line 3—3 of FIG. 2.
Figure 4:
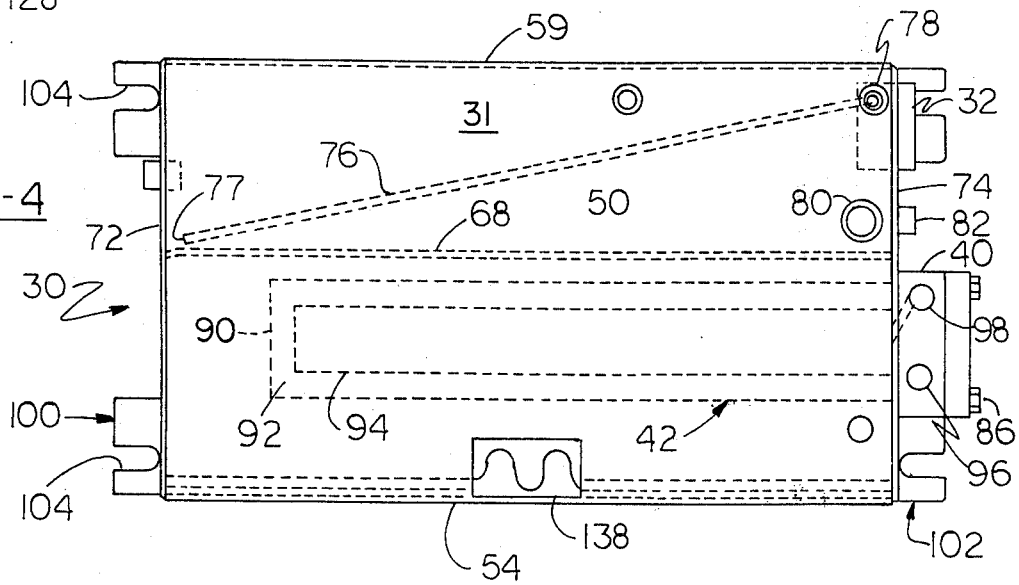
FIG. 4 is a top plan view of the reservoir housing illustrated in FIGS. 1-3.

Referring now to FIGS. 2, 3, and 4 the inventive reservoir housing 30 is illustrated in greater detail as comprising an upper support wall 50 having one of its lengthwise edges 52 bent downwardly to form a side wall 54 which, in turn, has its lower edge 56 bent at a right angle to form a support flange 58 (FIG. 3). The other lengthwise edge 59 of the upper support wall 50 has a right angle bend to form a second lengthwise side wall 60, the lower lengthwise edge 62 of which is similarly bent inwardly to form a bottom wall 64 which, in addition to the lengthwise flange 58, defines the bottom of the reservoir housing 30. The bottom wall 64 is bent along an inner lengthwise edge 66 to form an intermediate wall 68, the upper end of which is welded to the bottom surface of the upper support wall 50 as shown at 70.

As viewed in FIG. 4, the left end wall 72 and right end wall 74 are welded to the exposed edges of the walls 50, 54, 60, 64, and 68 to enclose the opposite ends of the housing 30. The attachment of the lengthwise edge of the wall 68 to the bottom surface of the upper support wall 50 and the attachment of the end walls 72 and 74 to that portion of the housing 30 associated with the walls 60, 64, and 68 is accomplished so as to provide the airtight chamber 31 therewithin. The chamber 31 functions as a reservoir which, as aforementioned, communicates with the charge pump 35 via conduit 34 and manifold 22. The outlet 32 is formed in the end wall 74.

As can best be seen in FIG. 4, the reservoir chamber 31 includes a vent line 76 which is attached to the underside of the upper support wall 50 and extends from its opening 77 from a point adjacent to the walls 73 diagonally across the upper portion of the chamber 31 to exit vertically through a coupling 78 whereby any air that may be trapped within the reservoir chamber 31 when the same is tilted may be expunged therefrom.

The upper support wall 50 and the side wall 74 are respectively provided with couplings 80 and 82 which function, respectively, as a means for filling and draining the reservoir chamber 31 with an appropriate fluid that is utilized by the pump 12 during the operation of the hydrostatic drive unit 10.

The side wall 74 is further provided with an aperture 84 through which a filter housing 90 extends, while the filter manifold 40 is attached to the wall 74 by means of suitable threaded fasteners 86 (FIG. 1) which extend through and engage threaded bores 88 formed at strategic locations around the aperture 84 in the side wall 74. Thus, the empty chamber 85 defined by the walls 50, 54, and 68 provides a convenient space for the storage of selected components of the hydrostatic drive unit 10.

The filter 42 comprises the manifold section 40 integrally connected to the filter housing 90 (illustrated in phantom lines in FIG. 4) which, in turn, defines therewithin a chamber 92 that stores a filter element 94. The filter 42 operates in a conventional manner in that fluid under pressure returned from the motor 46 enters from the conduit 39 through a coupling 96 into the chamber 92 and filters through the filter element 94. The filtered fluid is communicated via a coupling 98 to the high-pressure conduit 44 wherein the fluid is returned to the inlet of the fluid pump 12 in the aforementioned manner.

The reservoir housing 30 is further provided with flanges 100 and 102 respectively attached to the bottom side of the reservoir housing 30 along the bottom edges of the walls 72 and 74 by any suitable means, such as by welding. The flanges 100 and 102 are provided with U-shaped slots 104 which provide a simple means for fastening the hydrostatic drive unit 10 at a desired location.

Figure 7:
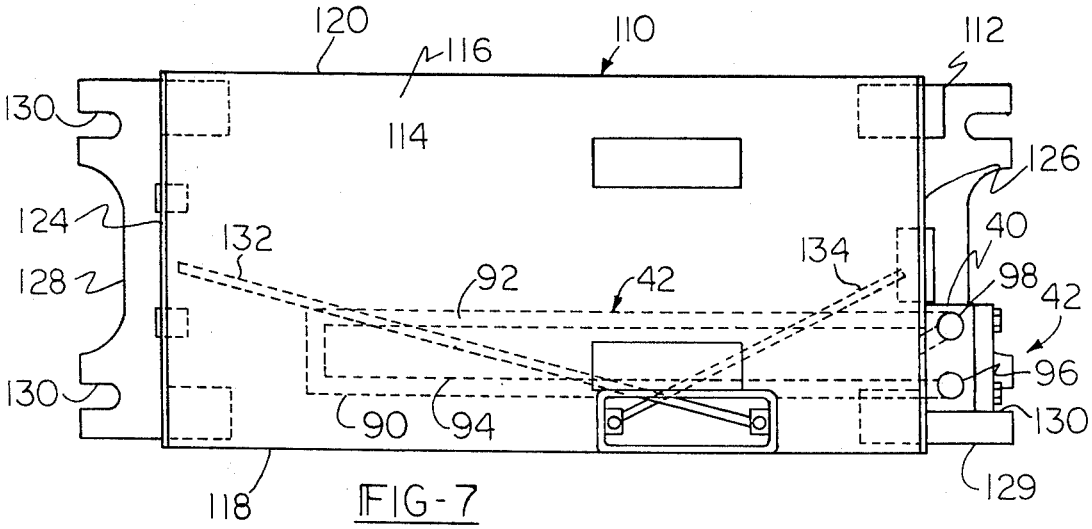
FIG. 7 is a top plan view of an alternate embodiment of the reservoir housing illustrated in FIGS. 1-4.
Figure 8:
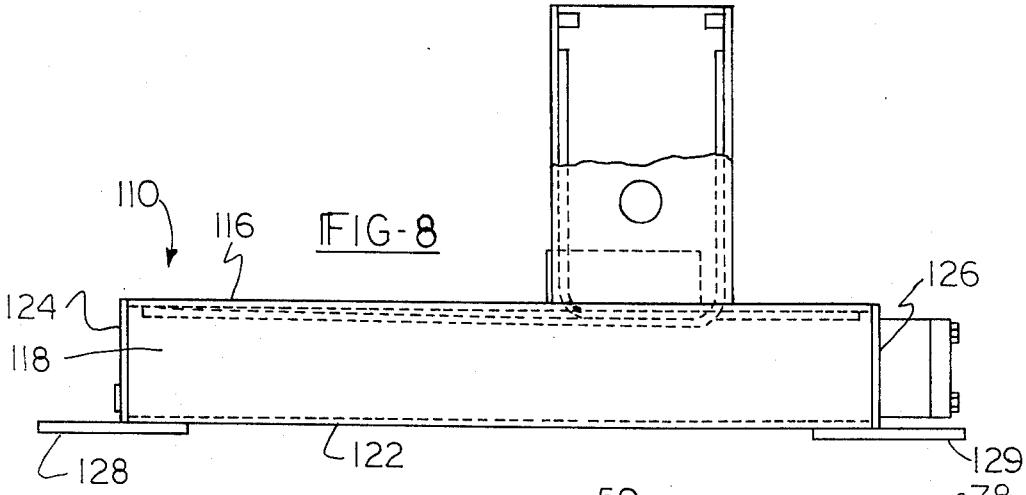
FIG. 8 is a side elevational view of the reservoir housing illustrated in FIG. 7.

Referring now to FIGS. 7 and 8 for a description of a modification of the present invention in the form of a reservoir housing 110 which is similar to the reservoir housing 30 in that it is adapted to mount and support the hydrostatic drive unit 10 and is provided with an outlet coupling 112 to which the conduit 34 is attached to draw fluid from a low-pressure reservoir chamber 114 defined by the housing 110 and to communicate this fluid to the charge pump 35 in the aforementioned manner. Additionally, the reservoir housing 110 is provided with the high-pressure filter 42, including the manifold 40 and the couplings 96 and 98 which respectively are adapted to be connected to the high-pressure conduits 39 and 44 so that fluid returned from the motor 46 may be directed through the coupling 96 into the chamber 92 defined by the filter housing 90. The fluid within the chamber 92 passes through the filter element 94 and exits through the coupling 98 and into the conduit 44 to be returned to the inlet of the pump 12 of the hydrostatic drive unit 10 in the aforementioned manner.

The housing unit 110 is rectangular in cross section in that it comprises an upper support wall 116 with downward depending side walls 118 and 120 which, in turn, are connected to a bottom wall 122 while the end edges of the aforementioned walls are enclosed by end walls 124 and 126 such that the entire chamber 114 is enclosed by the walls in an air-tight manner to provide a low-pressure reservoir for the hydraulic fluid utilized by the hydrostatic drive unit 10. Thus, the high-pressure filter housing 90 is stored directly within the chamber 114 and completely surrounded by the low-pressure fluid therewithin.

The reservoir housing 110 further comprises mounting flanges 128 and 129 which, in turn, have U-shaped mounting slots 130 to facilitate the simple mounting of a hydrostatic drive unit 10 at a desired location. Additionally, the reservoir housing 110 is provided with air vent lines 132 and 134 which function to remove any air trapped within the chamber 114 in a manner similar to the air vent lines 76 described hereinbefore.

It can thus be seen that the present invention provides a new and improved reservoir housing which functions both as a simple and compact support for a hydrostatic drive unit and as a simple and compact means for storing the high-pressure filter utilized by the hydrostatic drive unit. In one embodiment of the invention the reservoir housing is divided into two sections, one of which is utilized as the low-pressure reservoir chamber for storing the hydraulic fluid while the remaining hidden section 85 under the support wall of the reservoir housing 30 is adapted to function to mount and store a high-pressure filter. Additionally, the hidden section 85 within the reservoir housing 30 may be utilized to store other components of the hydrostatic drive unit 10, such as a cooler or heat exchanger schematically illustrated at 138 in FIG. 4.

In a second embodiment, when a greater amount of fluid is required, the compactness of design is still maintained by having the reservoir housing function as a completely air-tight chamber filled with the low-pressure hydraulic fluid while the high-pressure filter housing is stored directly within the reservoir chamber 114.

FIG. 6 schematically illustrates a servo-operated hydrostatic drive unit 139 wherein a fixed displacement motor 140 is reversed by reversing the variable displacement pump 142. In this situation fluid is returned from the motor 140 to pump 142 through either conduits 144 or 146 depending on the direction of rotation of the motor 140. The drive unit 139 is provided with two high-pressure filters 148 and 150 respectively disposed in conduits 144 and 146. The filters are provided with suitable check valve 152 to permit pressure fluid discharged from the pump 142 to bypass the filters 148 and 150, while fluid returned from the motor 140 will be filtered through one of the filters 148 or 150 depending on the direction of flow. In this situation both filters 148 and 150 can be mounted within the reservoir housing 30 or 110 in the aforementioned manner.

While only two examples of the present invention have been disclosed, it should be understood to those skilled in the art of fluid power units and reservoirs for such fluid power units that other forms of applicant's invention may be had without departing from the spirit of the invention or the scope of the appended claims.

What is claimed is as follows:

1. A hydrostatic drive unit of the type adapted to be connected in a closed-loop fashion to a fluid motor, said drive comprising:

a reservoir housing having an upper support surface;

a pump;

conduit means for connecting said pump to said motor in a closed-loop fashion;

fastening means for attaching said pump to said upper surface such that said housing supports said pump;

said reservoir housing having an enclosed chamber beneath said support surface, said chamber defining a reservoir for storing fluid at a low pressure;

means for communicating the fluid in said chamber to said closed-loop conduit means; and a high-pressure filter for filtering fluid in said closed-loop conduit means as said fluid is returned to the inlet of said pump, said reservoir housing storing said high-pressure filter beneath said housing support surface; said housing having a lower surface that is connected to the ends of said upper surface by side walls and end walls which completely enclose said housing in a fluid-type manner and which define said enclosed chamber; said high-pressure filter comprising a filter housing and a filter element disposed therein, said housing of said fluid filter being disposed within said enclosed chamber, whereby said high-pressure filter is stored directly within said low-pressure fluid chamber and said filter element is not in direct fluid communication with said enclosed chamber.

* * * * *